US006866589B1

(12) United States Patent
Widrick et al.

(10) Patent No.: US 6,866,589 B1
(45) Date of Patent: Mar. 15, 2005

(54) ICE RINK

(75) Inventors: Kent L. Widrick, Castorland, NY (US); John D. Ross, Lowville, NY (US); John H. Ross, Lowville, NY (US)

(73) Assignee: Innovative Products Incorporated, Lowville, NY (US)

( * ) Notice: Subject to any disclaimer, the term of this patent is extended or adjusted under 35 U.S.C. 154(b) by 0 days.

(21) Appl. No.: 10/668,222

(22) Filed: Sep. 24, 2003

(51) Int. Cl.[7] ..... A63C 19/10
(52) U.S. Cl. ..... 472/90
(58) Field of Search ..... 472/88, 90, 91

(56) References Cited

U.S. PATENT DOCUMENTS 2,587,855 A * 3/1952 Johnson ..... 62/66
3,771,891 A * 11/1973 Nirenski et al. ..... 404/40
4,038,834 A * 8/1977 Roberts ..... 62/235
4,169,688 A * 10/1979 Toshio ..... 404/40
4,667,481 A * 5/1987 Watanabe et al. ..... 62/235
4,673,609 A * 6/1987 Hill ..... 428/187
5,737,472 A * 4/1998 Bernasson et al. ..... 385/123
5,820,470 A * 10/1998 Saunders ..... 472/92
5,836,714 A * 11/1998 Christensen ..... 404/6
6,139,438 A * 10/2000 Park et al. ..... 472/90
6,521,304 B1 * 2/2003 Kajiyama et al. ..... 428/15

* cited by examiner

*Primary Examiner*—K. T. Nguyen
(74) *Attorney, Agent, or Firm*—Dennison, Schultz, Dougherty & MacDonald

(57) ABSTRACT

An ice rink defines a predetermined shape and includes a source of black and/or white light for illuminating the surface of the rink. In one form, the rink includes a plurality of rectangular synthetic panels and a plurality of adjusting elements for forcing the panels tightly together and for compensating for changes in temperature. The panels also include a plurality of grooves and a plurality of metal splines which are dimensioned to fit into the grooves of adjacent panels to provide a smooth skating surface.

3 Claims, 4 Drawing Sheets

ICE RINK

FIELD OF THE INVENTION

This invention relates to an ice rink having a luminescent surface which is illuminated by ultraviolet light and more particularly to an artificial ice rink which includes a plurality of juxtapositioned synthetic resin panels. The invention also relates to an artificial ice rink which includes a plurality of juxtapositioned synthetic resin panels and an adjustment mechanism for maintaining the panels tightly together.

BACKGROUND FOR THE INVENTION

Ice skating is a popular sport, but because of changes in weather and other factors, it is dependent on the use of indoor ice rinks. Such rinks are used for ice hockey, figure skating and as recreational skating. Many of the rinks are also dependent on the use of natural ice which requires the installation of expensive refrigeration systems to keep the ice surface at the proper temperature and prevent melting. The use of natural ice also requires periodic resurfacing to maintain an ice surface that is smooth and even enough to permit skating. Such resurfacing is normally accomplished by an expensive self-propelled ice surface refinishing machine, often referred to as a Zamboni machine.

In more recent years, artificial ice skating rink assemblies have been developed, as for example, disclosed in the Park et al. U.S. Pat. No. 6,139,438, which is incorporated herein in its entirety by reference. As disclosed therein, an artificial ice skating rink assembly includes a plurality of synthetic resin panels for providing an ice skating surface. Each of the panels has an elongated channel with longitudinal and transverse axes along its edges. Elongate splines are also provided for slidable insertion into a channel in a lateral direction along the transverse axis of the channel and for slidable receipt of another panel which is forced in a lateral direction into slidable engagement with the spline. In this way, separate panels are retained together exclusively by the spline mean against relative motion along the transverse axes of their respective channels.

Many natural and synthetic ice rinks experience relatively heavy usage particularly during the winter months. Nevertheless, there is a need to attract more skaters during off times and off seasons. Additional skaters are needed to offset the expenses associated with operating a rink irrespective of the use of natural or synthetic surfaces.

It is presently believed that ice rinks in accordance with the present invention will attract new skaters by providing a relaxed fun atmosphere. It is also believed that ice rinks in accordance with the present invention can be used to provide more interesting and exciting presentations and provide interest and excitement to a new form of ice hockey. Such rinks are also believed to provide improved training for young hockey players and may reduce the likelihood of injury due to spacing between portions of the surface.

It is also believed that ice rinks in accordance with the present invention will provide a smooth and more desirable surface which can be installed in a rink at a competitive cost and which can be readily adjusted to accommodate for changes in temperature or uneven stresses caused by the skaters.

Further, skating rinks in accordance with a preferred embodiment of the invention are relatively easy to install and do not need plumbing or refrigeration and can be used year round. Such rinks are also free of refrigerant gas. In addition, the surfaces in such rinks resist bacteria build-up, are non-toxic and can be installed on most solid bases such as a cement pad or wood flooring and can be readily removed and replaced so that a building can be used for other activities. It is also contemplated that the rinks in accordance with the present invention can be made in portable form and moved from one building to another.

BRIEF SUMMARY OF THE INVENTION

In essence, the present invention contemplates an ice rink with a luminescent skating surface that has a low light level glow which is somewhat similar to the reflected light of the moon. The ice rink may include natural or synthetic ice, has a predefined area that may be defined by the luminescent area or other means. A source of ultraviolet light and means for directing ultraviolet light onto the skating surface are also provided to thereby illuminate a skating area with a low level light glow.

In a second embodiment of the invention, an artificial ice rink includes a plurality of luminescent synthetic resin panels wherein each of the panels has a substantially planar upper major surface, a substantially planar lower major surface and peripheral sides extending between the upper and lower surfaces.

In the second embodiment of the invention each of the sides define an elongated groove which extends laterally into the panel. The artificial rink also includes a plurality of elongated splines which are preferably made of steel but may be made of the same synthetic resin as the panels. The panels are placed or positioned adjacent to one another in an abutting relationship with adjacent panels connected by one of the splines. The splines are fitted into the respective grooves of adjacent sides to form a smooth upper skating surface.

An outer frame is disposed around and in contact with an outer periphery of the plurality of connected panels for maintaining the panels in an abutting relationship notwithstanding lateral forces due to changes in temperature and/or the forces of a skate blade contacting a line of contact between adjacent panels.

As in the first embodiment of the invention, the second embodiment of the invention also includes a source of ultraviolet light and means such as a reflector or reflective bulb for directing ultraviolet light onto the skating surface. Directing ultraviolet light onto the luminescent panels illuminates the skating surface with a low light level glow and gives it a moonlight appearance.

In a preferred form of the second embodiment of the invention a fixed frame is provided outside of the outer frame. The fixed frame may for example be fixed with respect to a concrete pad and includes an adjustment mechanism such as a plurality of screw members or bolts in which one end is in contact with a portion of the outer frame for forcing the panels tightly together and for compensating for changes in temperature.

A third embodiment of the invention contemplates an artificial ice rink which includes a plurality of synthetic resin panels wherein each of the panels has a planar upper and a planar lower surface and peripheral edges extending between the surfaces. Each of the edges define a lateral extending elongated groove. A plurality of elongated synthetic resin splines or steel splines are adapted to fit laterally into the grooves of adjacent panels to thereby form a skating surface made up of a plurality of the panels. An outer frane and adjusting means are also provided for holding the panels tightly together in an abutting relationship.

The invention will now be described in connection with the accompanying drawings wherein like reference numerals have been used to identify like parts.

DESCRIPTION OF THE PREFERRED EMBODIMENTS OF THE INVENTION

Figure 1:
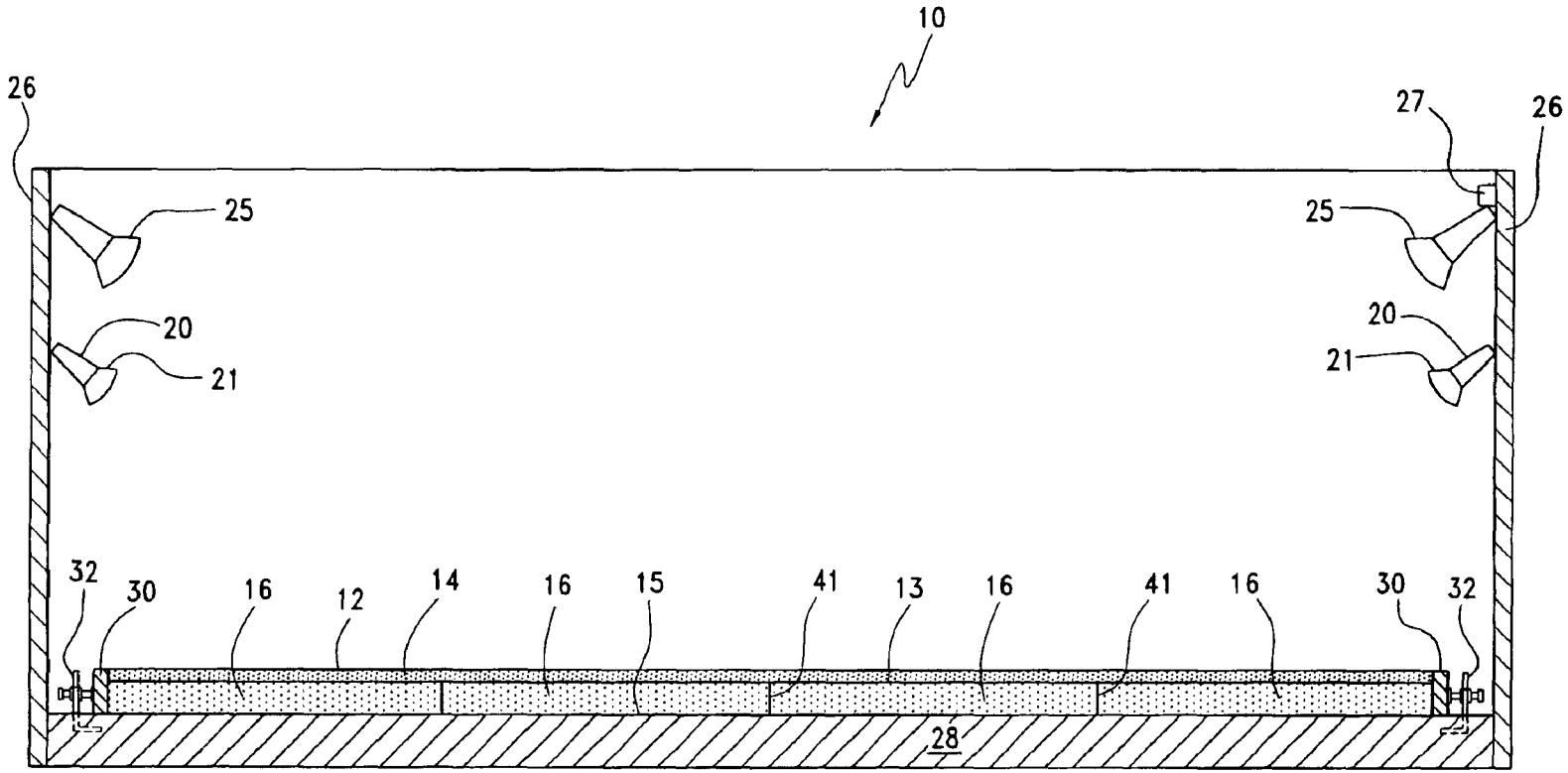
FIG. 1 is a schematic side elevational view of an ice rink in accordance with one embodiment of the invention.
Figure 2:
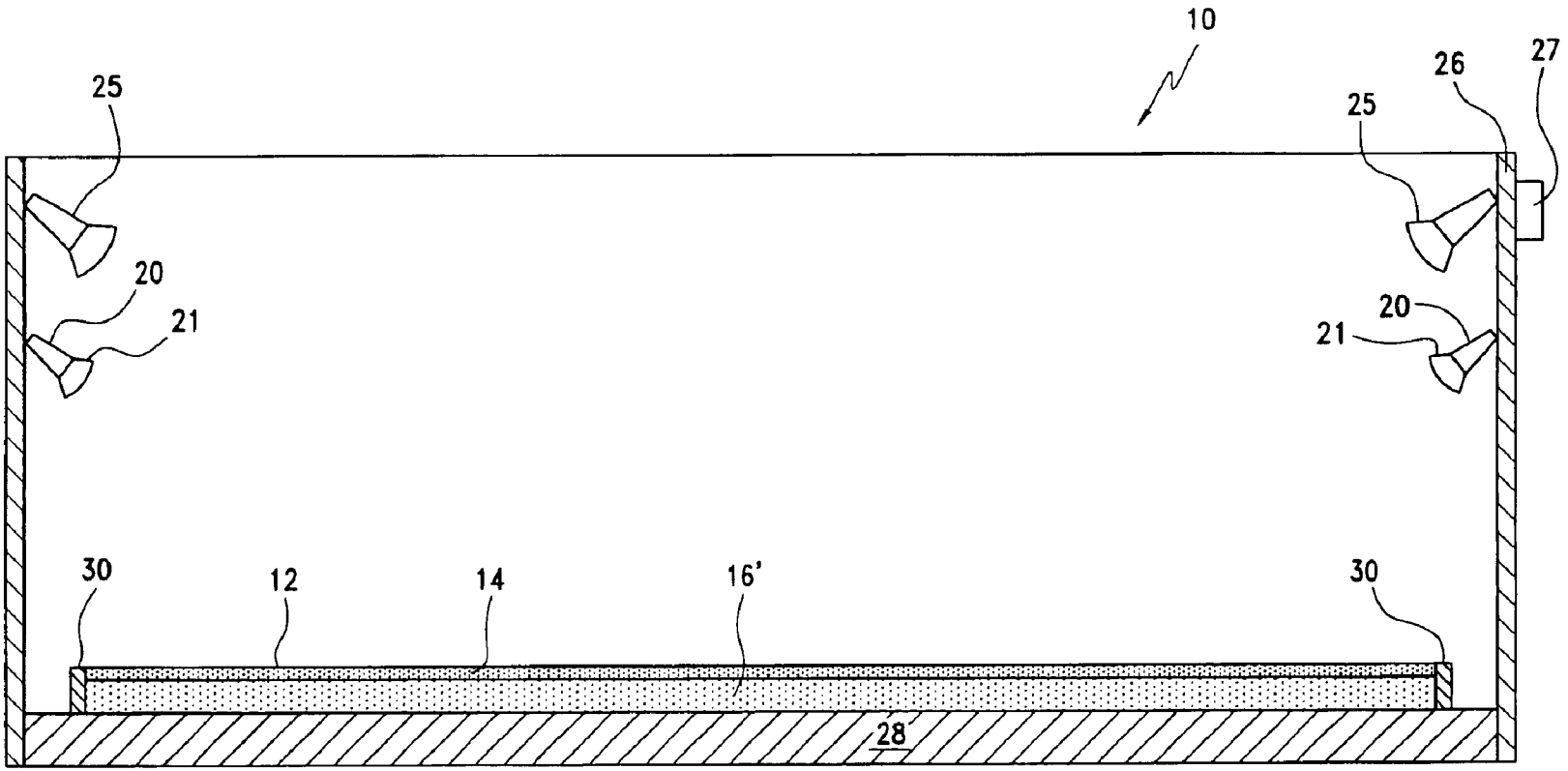
FIG. 2 is a side elevational view of an ice rink in accordance with another embodiment of the invention.
Figure 3:
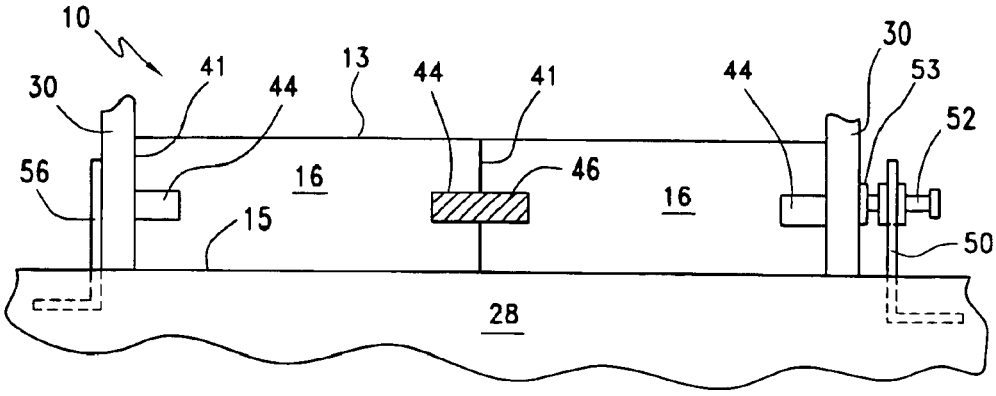
FIG. 3 is a schematic illustration of two adjacent panels, a spline and an adjustment mechanism in accordance with the invention.

Referring now to FIGS. 1–3, an ice rink 10 includes a luminescent skating surface 12. As shown in FIG. 1 the skating surface 12 is a relatively thin luminescent coating or layer 14 which includes a fluorescent or phosfluorescent dye. The layer 14 may be a coating or thin layer of natural ice or a thin coating of a lubricant on top of a plurality of synthetic resin panel 16.

It is also contemplated that the luminescent material may be dispersed in a base layer of natural ice 16' (see FIG. 2) or in each of a plurality of synthetic resin panels 16 as shown in FIG. 2. In one case, each of the synthetic resin panel 16 is provided with an ultraviolet light sensitive dye or pigment at or in sufficiently close proximity to its upper surface such that the dye or pigment will visibly fluoresce when subjected to the ultraviolet light emitted by a light source 20. As illustrated, the light source 20 includes a reflective surface area 21 for directing the light onto the surface 12.

Many types of ultraviolet light sensitive dyes or pigments may be used and selected for a desired color to be generated when the dye fluoresces. It is also contemplated that different dyes or pigments may be selected for different panels to provide a multicolor effect. One suitable dye is "Columbia Blue" Day-Glo Tracer Dye D-298 which is available from Day-Glo Color Corp. of Cleveland, Ohio. This dye is essentially colorless in daylight but fluoresces intense blue under ultraviolet light. It fluoresces brilliantly under ultraviolet light having a wavelength in the range of 360–380 nanometers.

The ice rink 10 also includes a source of white light such as a plurality of flood lights 25 which are used to illuminate the rink 10 for ordinary skating. As illustrated, the flood light 10 and ultraviolet light sources 20 are mounted in a conventional manner on the walls 26. In practice, the operation of a skating rink would ordinarily illuminate the skating surface with white light and then turn on the ultraviolet light source and turn off or reduce the intensity of the white light for producing a moonlit, eerie or other effect. The intensity of the white light may be changed by conventional rheostat 27. As shown in FIGS. 1–3, the synthetic resin panels 16 are supported by any suitable base such as a cement slab 28. The panels 16 are also prevented from lateral movement by a plurality of frame members 30 and as shown in FIGS. 1–4 by a plurality of angle irons on ends 32 which are embedded in and extend upwardly out of the cement slab 28. A bolt 35 or the like is used to force the panels 16 tightly together and prevent lateral movement of the panels 16.

In practice, a plurality of ½" bolts 35 each with a nut 33 welded to an inside of the angle end 32 engage a flat plate 34 to force the frame 30 in an inward direction. Locking means such as a double nut may be used at the end of the bolt.

Referring now to FIG. 3, an artificial skating rink 10 includes a plurality of synthetic panels 16 which are supported on the base 28, as for example a cement pad or other flat surface. As shown, the panels 16 are of a rectangular shape and preferably have a thickness of between about ¾" to one inch. The panels 16 have a substantially planar upper major surface 13, a substantially lower major surface 15 and peripheral sides 41 which extend between the upper and lower surfaces.

The panels may be made of a high molecular weight polyolefin or the like. Suitable materials may also include hydrophobic ingredients such as calcium stearate which tends to impart a degree of lubricity to the surface of the panels. The panels may also include a glyceral, glyceride or the like for additional lubricity, stabilizers and etc. as will be well understood by persons of ordinary skill in the art.

Each of the panels 16 define an elongated groove 44 in each side thereof between its upper major surface 13 and lower major surface 15. The groove 44 is preferably machined into the edges of the panel and has a thickness of about ⅛" and a depth of about ½" to about one inch. An elongated spline 46 is preferably made of steel but may be made of the same material as the panel 16 or other suitable material. The spline 46 is dimensioned to fit in the groove 44 with a relatively tight fit but still readily slidable into the groove so that the edge 41 of the panels 16 fit tightly together and provide a smooth skating surface.

Figure 4B:
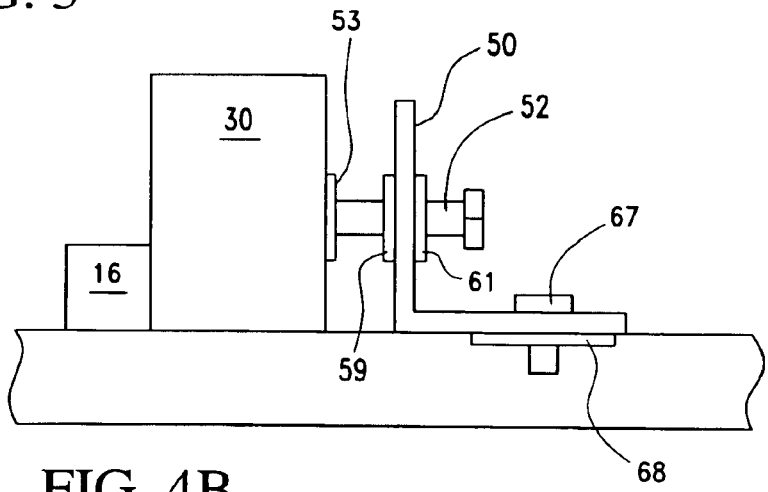
FIG. 4 is a plan view of a skating rink in accordance with one embodiment of the invention.
FIG. 4*a* is a top or plan view of a wedge assembly for maintaining a plurality of panels tightly together in accordance with one embodiment of the invention; and, FIG. 4*b* is a side elevational view of an adjustment mechanism in accordance with one embodiment of the invention and which is adapted for installation on an existing floor.
Figure 4A:
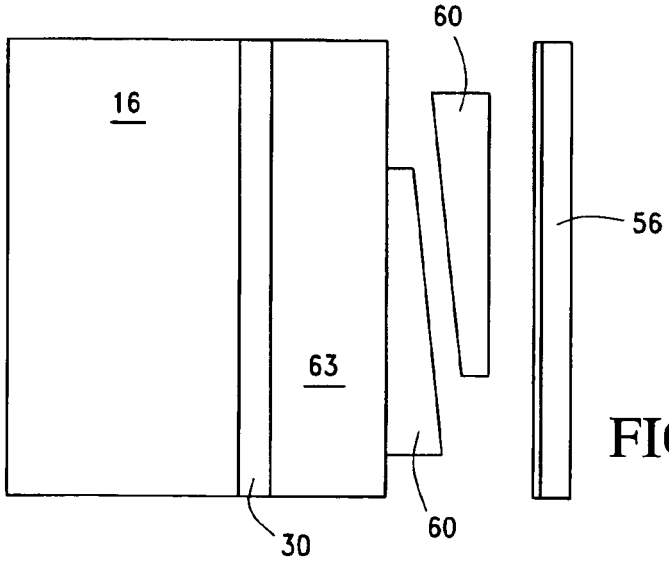
Figure 4:
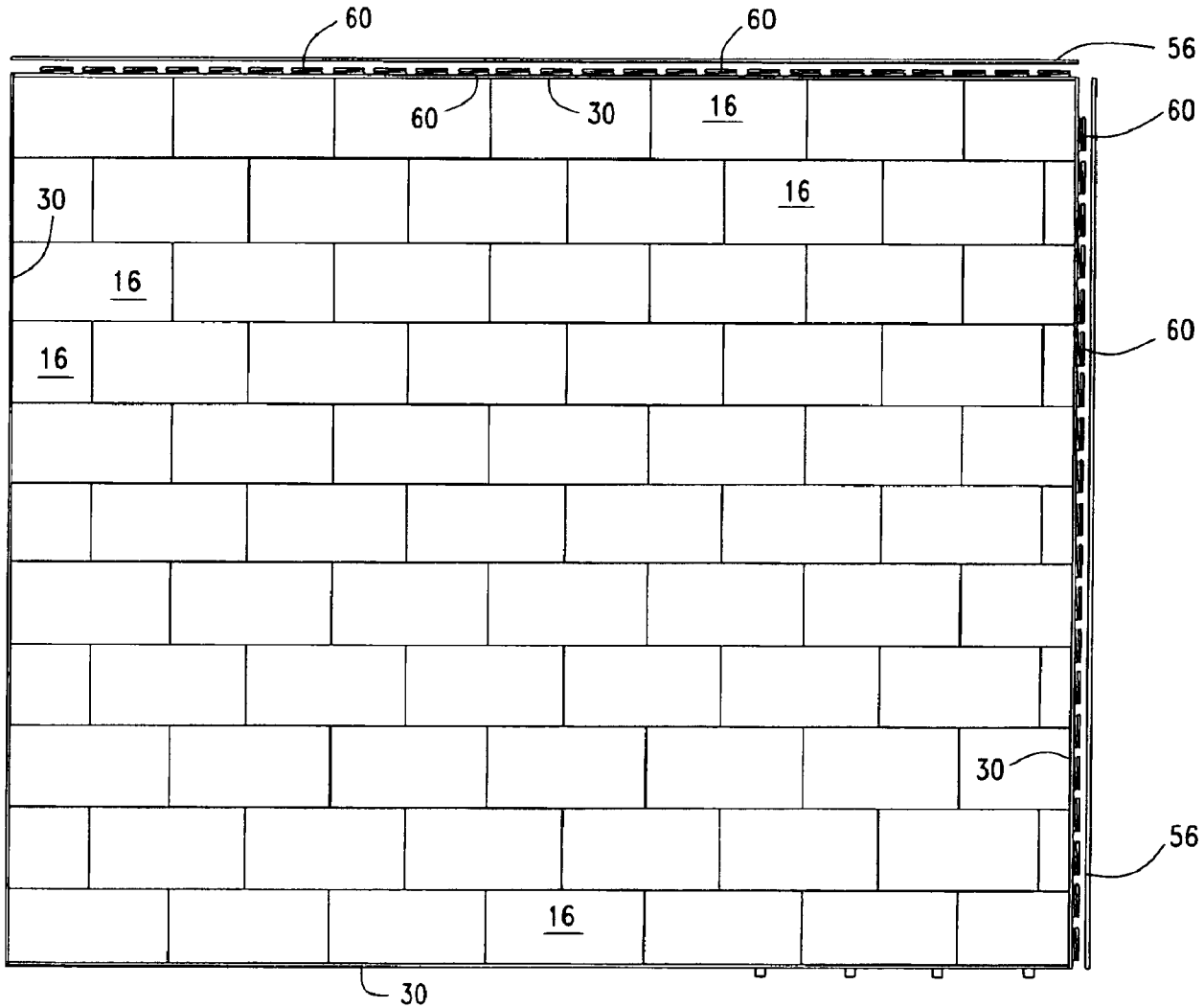

As shown in FIGS. 3 and 4, a frame 30 extends around an outer periphery of the rink and may comprise a 2×6 wood frame. A ¼" by 1½" by 1½"×1 inch angle iron or edge 50 is embedded in the concrete slab or bolted to the floor and includes an opening or hole in an upward extending portion thereof. As illustrated, a nut 59 is welded to an inner side and a ½" bolt 52 threaded through the nut to engage a flat metal plate 53 and press the plate 53 against the frame 30. Tightening or loosening the bolt then allows the frame to move in a transverse direction to accommodate expansion of the panels due to changes in temperature. The angle irons 50 are placed along two sides of the rink 10 at a distance of about 4 feet from one another. For smaller ice rinks the angle irons 50 may be spaced closer together.

A second angle iron or fixed member 56 is also a 1½"×1½"×¼" angle iron which is disposed along two adjacent sides of the ice rink 10 and may be of any length as for example 8 feet or more. The fixed member may also be set in the cement pad or bolted or otherwise fixed to the cement pad or wood floor and abuts the frame 30 so that the panels 16 are forced against the members 56 by means of the bolts 52.

It is also contemplated that a double nut can be used to lock the bolt 52 in a set position. Then, if a slight spacing develops between one or more adjacent panels the bolts 52 are tightened to force the panels together. In addition, for changes in seasons, the bolts 52 are loosened or tightened to accommodate expansion or contraction due to changes in temperature. It has also been found that for larger rinks adjustment means on all four sides of a rectangular rink may be needed.

Additional means for maintaining the panels 16 tightly together and to avoid spacing between adjacent panels is shown more clearly in FIGS. 4, 4*a* and 4*b*. As shown more clearly in FIGS. 4 and 4*a*, pairs of wooden wedges 60 are disposed between the frame member 30 and fixed member 56 along two sides of the ice rink 10 as shown in FIG. 4*a* the wedges 60 may be separated from the frame 30 by a kick board 63.

FIG. 4*b* is a detailed illustration of the adjustment mechanism for installation in a wooden floor. In such installations, the angle ends 50 are secured to a floor by means of conventional floor plates 68 and corresponding bolts 67. As shown, the bolt 52 extends through an upper portion of the angle iron 50 and nut 56 and may be locked in position by a nut 61.

While a luminescent material may be incorporated in the synthetic panels, the use of different dyes may be incorporated in different panels to provide various designs. It is also contemplated to add the luminescent material to a lubricant that is applied to the surface of the synthetic panels.

While the invention has been described in connection with its preferred embodiments, it should be recognized that changes and modifications can be made therein without departing from the scope of the appended claims.

What is claimed is:

1. An artificial ice rink comprising a plurality of luminescent synthetic resin panels having a generally rectangular shape with each of said panels having a substantially planar upper major surface, a substantially planar lower major surface and peripheral sides extending therebetween and wherein said peripheral sides each define an elongated groove therein;

a plurality of elongated steel splines;

said panels positioned adjacent to and abutting one another with adjacent panels being connected by means of one of said steel splines being mutually fitted into the respective grooves of adjacent sides to thereby form a generally rectangular an upper skating surface;

a generally flat base for supporting said plurality of said luminescent synthetic resin panels thereon;

an outer frame disposed around and in contact with an outer periphery of said plurality of panels for maintaining said panels in an abutting relationship;

fixed frame adjustment means fixed to said base and operable on two sides of said generally rectangular upper skating surface for forcing and maintaining said panels tightly together and for compensating for changes in temperature;

a source of ultraviolet light disposed above said upper skating surface;

means for directing ultraviolet light onto said skating surface to thereby illuminate said upper skating surface with a low light level glow; and a variable source of white light disposed above said upper skating surface and means for directing white light onto the skating surface.

2. An artificial ice rink according to claim 1, in which said source of variable white light includes a rheostat.

3. An artificial ice rink according to claim 2, in which said frame adjustments means includes a fixed frame member and a plurality of bolts engaging said outer frame for moving said frame in a lateral direction to eliminate spacing between said panels.

* * * * *